US006371085B1

(12) United States Patent
Boecking

(10) Patent No.: US 6,371,085 B1
(45) Date of Patent: Apr. 16, 2002

(54) INJECTOR WITH A MULTILAYER PIEZOELECTRIC ACTUATOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/673,352

(22) PCT Filed: Jan. 14, 2000

(86) PCT No.: PCT/DE00/00122

§ 371 Date: Dec. 7, 2000

§ 102(e) Date: Dec. 7, 2000

(87) PCT Pub. No.: WO00/49286

PCT Pub. Date: Aug. 24, 2000

(30) Foreign Application Priority Data

Feb. 16, 1999 (DE) ..... 199 06 467

(51) Int. Cl.[7] ..... F02M 37/04

(52) U.S. Cl. ..... 123/498; 251/129.06; 239/584

(58) Field of Search ..... 123/467, 497, 123/498; 239/584; 251/129.06

(56) References Cited

U.S. PATENT DOCUMENTS

| | | | | | |
|---|---|---|---|---|---|
| 4,750,706 | A | * | 6/1988 | Schlagmuller | 251/129.06 |
| 5,004,945 | A | * | 4/1991 | Tomita et al. | 123/498 |
| 5,875,764 | A | * | 3/1999 | Kappel et al. | 122/467 |
| 6,085,990 | A | * | 7/2000 | Augustin | 239/584 |
| 6,253,736 | B1 | * | 7/2001 | Crofts et al. | 123/498 |
| 6,213,414 | B1 | * | 10/2001 | Stier et al. | 239/584 |
| 6,315,216 | B1 | * | 11/2001 | Boecking | 239/584 |

* cited by examiner

*Primary Examiner*—Thomas N. Moulis
(74) *Attorney, Agent, or Firm*—Ronald E. Greigg

(57) ABSTRACT

An injector for common rail Diesel injection systems of motor vehicles, having a multilayer piezoelectric actuator which has a multilayer actuator body. The actuator body is prestressed on a face end by a prestressing device and is seated inside a center longitudinal bore of an injector housing. The injector is characterized in that the prestressing device have at least one cup spring, which in a prestressing movement engages the face end of the actuator body opposite an injector valve (V), as well as a force transmission member seated in the injector housing and axially movable therein, the transmission member transmits the spring force of the at least one cup spring to the face end, toward the valve, of the actuator body.

14 Claims, 2 Drawing Sheets

INJECTOR WITH A MULTILAYER PIEZOELECTRIC ACTUATOR

CROSS-REFERENCES RELATED APPLICATION

This is a 35 USC 371 application of PCT/DE 00/00122 filed on Jan. 14, 2000

PRIOR ART

The invention relates to n injector, in particular for common rail Diesel injection s stems of motor vehicles, having a multilayer piezoelectric actuator which has a multilayer actuator body, prestressed on a face end by a prestressing means and seated inside a longitudinal bore of an injector housing.

From International Patent Disclosure WO 94/19598 (Siemens AG), an injector of this kind with a multilayer piezoelectric actuator is known. The accompanying FIG. 1 shows the portion of the known injector located round the actuator body. In the known injector, the means that prestress the actuator body 1 comprise a cup spring 4 toward the valve, which on one end rests on or engages an annular flange 3 located on the face end toward the valve of the actuator body 1 and on the other end rests or engages a radially inward- protruding shoulder 5 of the injector housing 2. In this case, the injector housing 2 itself forms the means for transmitting the prestressing force, exerted by the cup spring 4, to the other face end of the actuator body 1. The arrow V indicates the direction toward the valve. Because of the diameter of the cup spring 4 acting as a prestressing element, the outside diameter of the injector housing 2, at the point where the spring action is most critical, that is, where the injector housing passes through a cylinder head wall, is relatively large.

The situation is similar for the other known common rail injector, shown in accompanying FIG. 2. An actuator body 1 seated centrally inside an injector housing 2 is prestressed, in the known injector shown in FIG. 2, is prestressed on its face end by a prestressing bracket 6 with a right and left spring leg 6*a*, 6*b*, by means of a first force-centering pressure member 7 and a second force—centering pressure member 8. Since the two legs 6*a*, 6*b* of the prestressing bracket 6 require space on the left and right of the injector body 1, in this case as well it is not possible to reduce the outer diameter of the injector housing 2 in the critical region.

The result is that the prestressing elements used in conventional common rail Diesel injection systems of the prior art undesirably increase the diameter of the injector in the region of the piezoelectric actuator.

In order to make a common rail Diesel injection system with a multilayer piezoelectric actuator in a short structural design, the diameter of the components in the region of the actuator body must be selected to be as small as possible.

OBJECT AND ADVANTAGES OF THE INVENTION

It is thus an object of the invention to make an injector with a multilayer piezoelectric actuator that is better suited to common rail Diesel injection systems of motor vehicles and in which the outer diameter of the injector housing can be as small as possible.

An essential aspect of an injector according to the invention with a multilayer piezoelectric actuator is that the prestressing means have at least one cup spring, which in prestressing fashion engages the face end of the actuator body opposite an injector valve, as well as a force transmission member seated in the injector housing and axially movable therein, which member transmits the spring force of the cup spring or springs to the face and, toward the valve, of the actuator body.

Preferably, the actuator body has a circular- cylindrical cross-sectional form. In this case, at least in the region of the actuator body, the sleevelike injector housing has a circular-cylindrical inner and outer contour and surrounds the actuator body and the force transmission member, which forms a circular-cylindrical clamping sleeve, and the actuator body abuts a radial inner wall, toward the valve, of the clamping sleeve, and the cup spring or springs engage between the opposed inner wall on the face end of the clamping sleeve and the adjacent face end of the actuator body.

Thus the cup spring or strings that effect the prestressing are provided behind the actuator body, that is, on the side of the actuator body remote from the valve, thus making a slender design of the injector in the region of the actuator body possible. In other words, the thicker actuator head having the cup spring or cup springs is located in the noncritical region of the cylinder head of the internal combustion engine.

With this arrangement, relatively short common rail injectors with a multilayer piezoelectric actuator that are no longer than the conventional magnet valve injectors can be produced.

The above and further advantageous characteristics of the injector of the invention will become even clearer in the ensuing description of a preferred exemplary embodiment when this description is read in conjunction with the accompanying drawings.

DETAILED DESCRIPTION OF THE

Exemplary Embodiment

Figure 3:
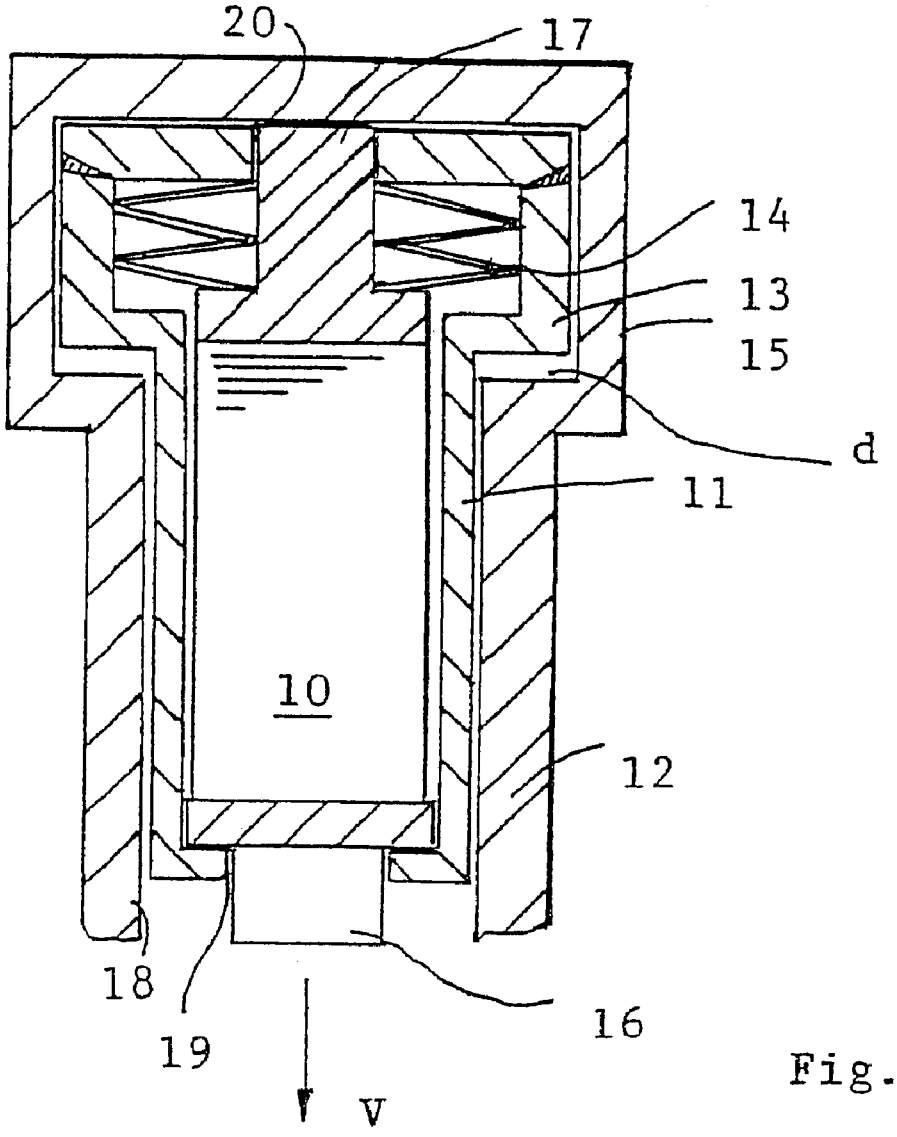
FIG. 3, in the form of a schematic longitudinal section, shows a preferred exemplary embodiment of an injector according to the invention with a multilayer piezoelectric actuator.

In FIG. 3, a cylindrical actuator body 10 of a multilayer piezoelectric actuator, which can take the form of a multilayer laminate of stacked layers of piezoelectric material and intervening metal or electrically conducting layers serving as electrodes, is prestressed on a face end by prestressing means. The prestressing means comprise a cup spring packet 14 and a cylindrical clamping sleeve 11, which are seated inside a cylindrical injector housing 12. The actuator body 10 of the multilayer piezoelectric actuator ends at the face end pointing toward the valve V, in a pressure bolt 16 which at that point passes through a central bore 19 in the cylindrical clamping sleeve 11. The face end of the actuator body 10 opposite the end toward the valve ends in a bracing element 17, which in turn has a boltlike end that protrudes through the central bore 20 of the clamping sleeve 11 and there abuts a radial inner wall of the injector housing 12.

If a pulsating electrical voltage is applied to the electrodes (not shown) of the actuator body 10, then the actuator body executes similarly pulsating strokes, thus changing the spacing between its face ends fastened by the aforementioned prestressing means, that is, the cup spring packet 14 and the clamping sleeve 11. In the process, the clamping sleeve 11, seated in the center longitudinal bore 18 of the injector housing 12, moves together with the end toward the valve, that is, together with the pressure bolt 16 of the actuator, in the axial direction V counter to the spring force exerted by the cup spring packet 14, since by means of the prestressing force of the cup spring packet 14 the clamping sleeve 11 is fastened between the end of the actuator toward the valve and the opposed end of the cup spring packet 14.

It can be seen clearly in FIG. 3 that the injector housing 12, in the portion opposite the end toward the valve of the actuator body 10, that is, at the place where the cup spring packet 14 is seated, and the clamping sleeve 11 inside this portion each form circular-cylindrical radial widened portions 15 and 13. In this way, the cup springs of the cup spring packet 14 can have a diameter that is adequate for a desired spring force. The radial length of the radial widened portion 13 of the clamping sleeve 11 is less, by the distance d, than the axial inside measure of the radial widened portion 15 of the injector housing 12, so that space remains available for the aforementioned axial motion, effected by the actuator strokes, of the clamping sleeve 11.

Figure 1:
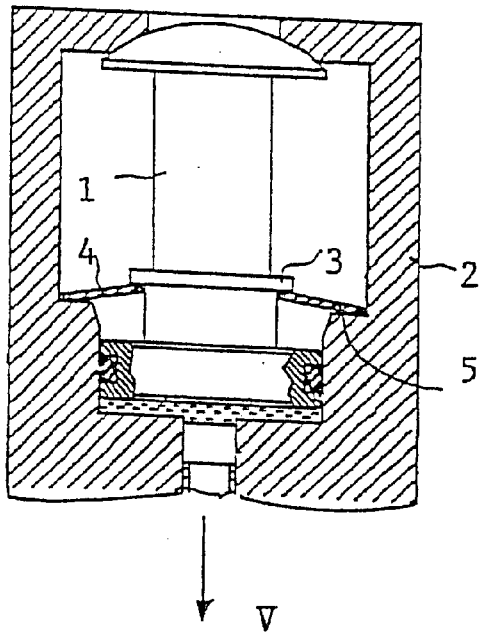
FIG. 1, in the form of a schematic longitudinal section, shows the already-described known injector, with a prestressing element, on the side toward the valve, embodied as a cup spring.
Figure 2:
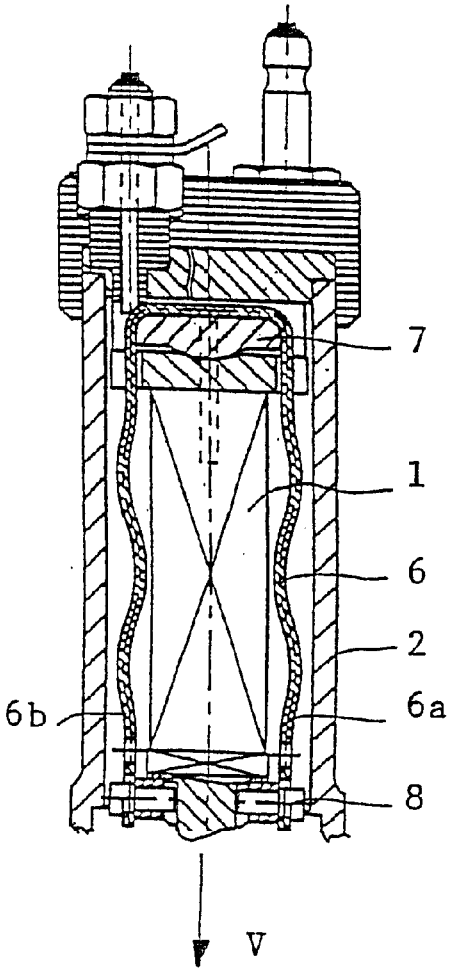
FIG. 2, in the form of a schematic longitudinal section, shows the other already-described known injector, which as its prestressing element contains a two-legged prestressing bracket.

The prestressing force, effected by the cup spring packet 14 centrally supported between the clamping sleeve 11 and the upper annular shoulder of the bracing element 17 and by the also centrally supported and axially movable clamping sleeve 11, makes further centering means for centering the prestressing force on the actuator body 10, of the kind needed by the spring tensing bracket 6 of FIG. 2 that has the two lateral legs 6*a*, 6*b* and takes the form of the pressure members 7 and 8, unnecessary.

Overall, the embodiment according to the invention, described above in conjunction with FIG. 3, of an injector with a multilayer piezoelectric actuator, because the prestressing element or in other words the cup spring packet 14 is located behind the actuator body 10, that is, at a position remote from the valve side of the actuator body 10, offers a slender design of the injector in the region of the relatively long piezoelectric actuator body 10, whose thicker head is located together with the cup spring packet 14 in the noncritical region of the cylinder head of the internal combustion engine. With the arrangement proposed according to the invention, designs of an injector equipped with a multilayer piezoelectric actuator that are no longer than conventional magnet valve injectors are possible.

The foregoing relates to a preferred exemplary embodiments of the invention, it being understood that other variants and embodiments thereof are possible within the spirit and scope of he invention, the latter being defined by the appended claims.

I claim:

1. An injector for common rail Diesel injection systems of motor vehicles, comprising a multilayer piezoelectric actuator which has a multilayer actuator body (10), prestressed on the actuator body is a face end by prestressing means (11, 14) and seated inside a center longitudinal bore (18) of an injector housing (12), the prestressing means (11, 14) have at least one cup spring (14), which during prestressing engages a face end of the actuator body (10) opposite an injector valve (V), as well as a force transmission member (11) seated in the injector housing (12) and axially movable therein, the transmission member transmits the spring force of the at least one cup spring (14) to the face end, toward the valve, of the actuator body (10).

2. The injector of claim 1, in which the actuator body (10) has a circular-cylindrical cross-sectional form.

3. The injector of claim 1, in which the injector housing (12) in sleevelike fashion surrounds the actuator body (10) and the force transmission member (11) and has a circular-cylindrical inside and outside contour, at least in a region of the actuator body (10).

4. The injector of claim 2, in which the injector housing (12) in sleevelike fashion surrounds the actuator body (10) and the force transmission member (11) and has a circular-cylindrical inside and outside contour, at least in a region of the actuator body (10).

5. The injector of claim 3, in which the force transmission member (11) is a circular-cylindrical clamping sleeve, and the actuator body (10) abuts a radial inner wall, toward the valve, of the clamping sleeve (11), and the at least one cup spring (14) engage between an opposed radial inner wall of the clamping sleeve (11) and the adjacent face end of the actuator body (10).

6. The injector of claim 4, in which the force transmission member (11) is a circular-cylindrical clamping sleeve, and the actuator body (10) abuts a radial inner wall, toward the valve, of the clamping sleeve (11), and the at least one cup spring (14) engage between an opposed racial inner wall of the clamping sleeve (11) and the adjacent face end of the actuator body (10).

7. The injector of claim 5, in which the at least one cup spring (14) and the end walls of the clamping sleeve (11) have central axial bores (19, 20), through each of which one bracing element (17) of the actuator body (10) and one pressure bolt (16), protruding from the actuator body (10) to the valve side (V), pass.

8. The injector of claim 6, in which the at least one cup spring (14) and the end walls of the clamping sleeve (11) have central axial bores (19, 20), through each of which one bracing element (17) of the actuator body (10) and one pressure bolt (16), protruding from the actuator body (10) to the valve side (V), pass.

9. The injector of claim 3, in which the injector housing (12) in the portion of the at least one cup spring (14) forms a radial circular-cylindrical widened portion (15);

that the clamping sleeve (11) ha a circular- cylindrical radial widened portion (13), which is movable in the circular-cylindrical widened portion (15) of the injector housing (14), and the at least one cup spring (14) have an outside diameter greater than the diameter of the actuator body (10) and are seated centrally in the circular-cylindrical radial widened portion (13) of the clamping sleeve (11).

10. The injector of claim 4, in which the injector housing (12) in the portion of the at least one cup spring (14) forms a ralial circular-cylindrical widened portion (15);

that the clamping sleeve (11) was a circular- cylindrical radial widened portion (13), which is movable in the circular-cylindrical widened portion (15) of the injector housing (14), and the at least one cup spring (14) have an outside diameter greater than the diameter of the actuator body (10) and are seated centrally in the circular-cylindrical radial widened portion (13) of the clamping sleeve (11).

11. The injector of claim 5, in which the injector housing (12) in the portion of the at least one cup spring (14) forms a radial circular-cylindrical widened portion (15);

that the clamping sleeve (11) has a circular-cylindrical radial widened portion (13), which is movable in the circular-cylindrical widened portion (15) of the injector housing (14), and the at least one cup spring (14) have an outside diameter greater than the diameter of the actuator body (10) and are seated centrally in the circular-cylindrical radial widened portion (13) of the clamping sleeve (11).

12. The injector of claim 6, in which the injector housing (12) in the portion of the at least one cup spring (14) forms a radial circular-cylindrical widened portion (15);

that the clamping sleeve (11) has a circular-cylindrical radial widened portion (13), which is movable in the circular cylindrical widened portion (15) of the injector housing (14), and the at least one cup spring (14) have an outside diameter greater than the diameter of the actuator body (10) an d are seated centrally in the circular-cylindrical radial widened portion (13) of the clamping sleeve (11).

13. The injector of claim 7, in which the injector housing (12) in the portion of the at least one cup spring (14) forms a radial circular-cylindrical widened portion (15);

that the clamping sleeve (11) h as a circular-cylindrical radial widened portion (13), which is movable in the circular-cylindrical widened portion (15) of the injector housing (14), and the at least one cup spring (14) have an outside diameter greater than the diameter of the actuator body (10) and are seated centrally in the circular-cylindrical radial widened portion (13) of the clamping sleeve (11).

14. The injector of claim 8, in which the injector housing (12) in the portion of the at least one cup spring (14) forms a radial circular-cylindrical widened portion (15);

that the clamping sleeve (11) has a circular-cylindrical radial widened portion (13), which is movable in the circular-cylindrical widened portion (15) of the injector housing (14), and the at least one cup spring (14 have an outside diameter greater than the diameter of the actuator body (10) and are seated centrally in the circular-cylindrical radial widened portion (13) of the clamping sleeve (11).

* * * * *